US010876373B2

(12) United States Patent
Rorvik et al.

(10) Patent No.: US 10,876,373 B2
(45) Date of Patent: Dec. 29, 2020

(54) NON-ROTATING DRILL-IN PACKER

(71) Applicant: Halliburton Energy Services, Inc., Houston, TX (US)

(72) Inventors: Helge Rorvik, Sandnes (NO); Peter Elliot Smith, By Beauly (GB); David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 145 days.

(21) Appl. No.: 15/777,630

(22) PCT Filed: Dec. 21, 2015

(86) PCT No.: PCT/US2015/067068
§ 371 (c)(1),
(2) Date: May 18, 2018

(87) PCT Pub. No.: WO2017/111901
PCT Pub. Date: Jun. 29, 2017

(65) Prior Publication Data
US 2018/0371864 A1 Dec. 27, 2018

(51) Int. Cl.
*E21B 33/12* (2006.01)
*E21B 7/20* (2006.01)
(Continued)

(52) U.S. Cl.
CPC ..... *E21B 33/12* (2013.01); *E21B 7/20* (2013.01); *E21B 33/13* (2013.01); *E21B 34/06* (2013.01);
(Continued)

(58) Field of Classification Search
CPC . E21B 33/12; E21B 7/20; E21B 33/13; E21B 33/128; E21B 33/1295;
(Continued)

(56) References Cited

U.S. PATENT DOCUMENTS 3,722,608 A * 3/1973 Faulk ..... E21B 4/003 175/65
4,057,118 A 11/1977 Ford
(Continued)

FOREIGN PATENT DOCUMENTS

EP 1264960 A2 12/2002
GB 2312908 A 12/1997

OTHER PUBLICATIONS

Korean Intellectual Property Office, PCT/US2015/067068, International Search Report and Written Opinion, dated Sep. 20, 2016, 18 pages, Korea.
(Continued)

*Primary Examiner* — Michael R Wills, III

(57) ABSTRACT

Various embodiments include methods and apparatus structured to increase efficiencies of a drilling operation. An apparatus can be structured to include a sleeve structured to operatively fit over a liner or a casing in a wellbore. The sleeve can be structured with a packer element disposed such that the liner or the casing is capable of rotation within the sleeve when the sleeve with the packer element is operationally non-rotating. Additional apparatus, systems, and methods can be implemented in a variety of applications.

23 Claims, 16 Drawing Sheets

(51) Int. Cl.

| | |
|---|---|
| ***E21B 33/13*** | (2006.01) |
| ***E21B 34/06*** | (2006.01) |
| *E21B 33/127* | (2006.01) |
| *E21B 47/06* | (2012.01) |
| *E21B 47/09* | (2012.01) |

(52) U.S. Cl.
CPC ..... *E21B 33/127* (2013.01); *E21B 47/06* (2013.01); *E21B 47/09* (2013.01)

(58) Field of Classification Search
CPC ..... E21B 34/06; E21B 47/06; E21B 47/09; E21B 33/127; H04L 5/18; H04L 51/34
See application file for complete search history.

(56) References Cited

U.S. PATENT DOCUMENTS

| | | | | |
|---|---|---|---|---|
| 4,869,323 | A | 9/1989 | Stagg | |
| 5,743,333 | A * | 4/1998 | Willauer | E21B 33/1277 166/122 |
| 6,050,131 | A * | 4/2000 | Willauer | E21B 33/127 73/37 |
| 2003/0213620 | A1 | 11/2003 | Krueger | |
| 2004/0016571 | A1 | 1/2004 | Krueger | |
| 2008/0217063 | A1 | 9/2008 | Moore et al. | |
| 2010/0224358 | A1 | 9/2010 | Stokka et al. | |
| 2011/0114338 | A1 | 5/2011 | Casassa et al. | |
| 2011/0203794 | A1 | 8/2011 | Moffitt et al. | |
| 2015/0330150 | A1 * | 11/2015 | Strachan | E21B 7/067 175/45 |

OTHER PUBLICATIONS

United Kingdom Intellectual Property Office, Application No. GB1619033.2, Examination Report, dated Mar. 12, 2019, 4 pages, Great Britain.

* cited by examiner

NON-ROTATING DRILL-IN PACKER

CROSS-REFERENCE TO RELATED APPLICATIONS

This application is a U.S. national stage patent application of International Patent Application No. PCT/US2015/067068, filed on Dec. 21, 2015, the benefit of which is claimed and the disclosure of which is incorporated herein by reference in its entirety.

TECHNICAL FIELD

The present invention relates generally to apparatus related to drilling for oil and gas exploration.

BACKGROUND

In drilling wells for oil and gas exploration, the environment in which the drilling tools operate is at significant distances below the surface. Due to harsh environments and depths in which drilling in formations is conducted; enhanced efficiencies to drilling mechanisms are desirable.

In a drilling operation, the path of the drilling can involve drilling from one formation into another formation in which the transition from the first formation to the second formation is accompanied by a difference in pressure. In the case where the drilling is from a higher pressure into a lower pressure, the formation around the drilling elements can move into these elements causing a stuck condition with a pipe unable to rotate. This stuck condition can lead to the drilling not being able to continue. To address this issue, use of a clutch mechanism has been proposed. However, such a clutch mechanism has been known to have a high potential for failing.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, electrical, and mechanical changes may be made to these embodiments. The various embodiments are not necessarily mutually exclusive, as some embodiments can be combined with one or more other embodiments to form new embodiments. The following detailed description is, therefore, not to be taken in a limiting sense.

In various embodiments, a single run liner drilling isolation assembly can be integrated with a free rotating packer element. Such a structure can provide lower annular zonal isolation prior to cementing to the liner without losses to the formation below the isolation assembly. This arrangement can be implemented to obtain qualified annular cemented barrier over a liner section. A liner typically is a string of casing that is suspended from inside a previous casing string, where the liner does not extend to the surface.

In high angle wells, a liner should be rotated during pumping of cement to achieve full circumferential cement coverage in the annular space between the liner and the formation wall of the open hole. A free rotating packer element integrated on a lower liner drilling assembly can be implemented to allow for the liner to rotate free above the set packer during the cement phase. The system may remove the risk of cement losses and therefore allow for a qualified annular barrier of cement.

Figure 1:
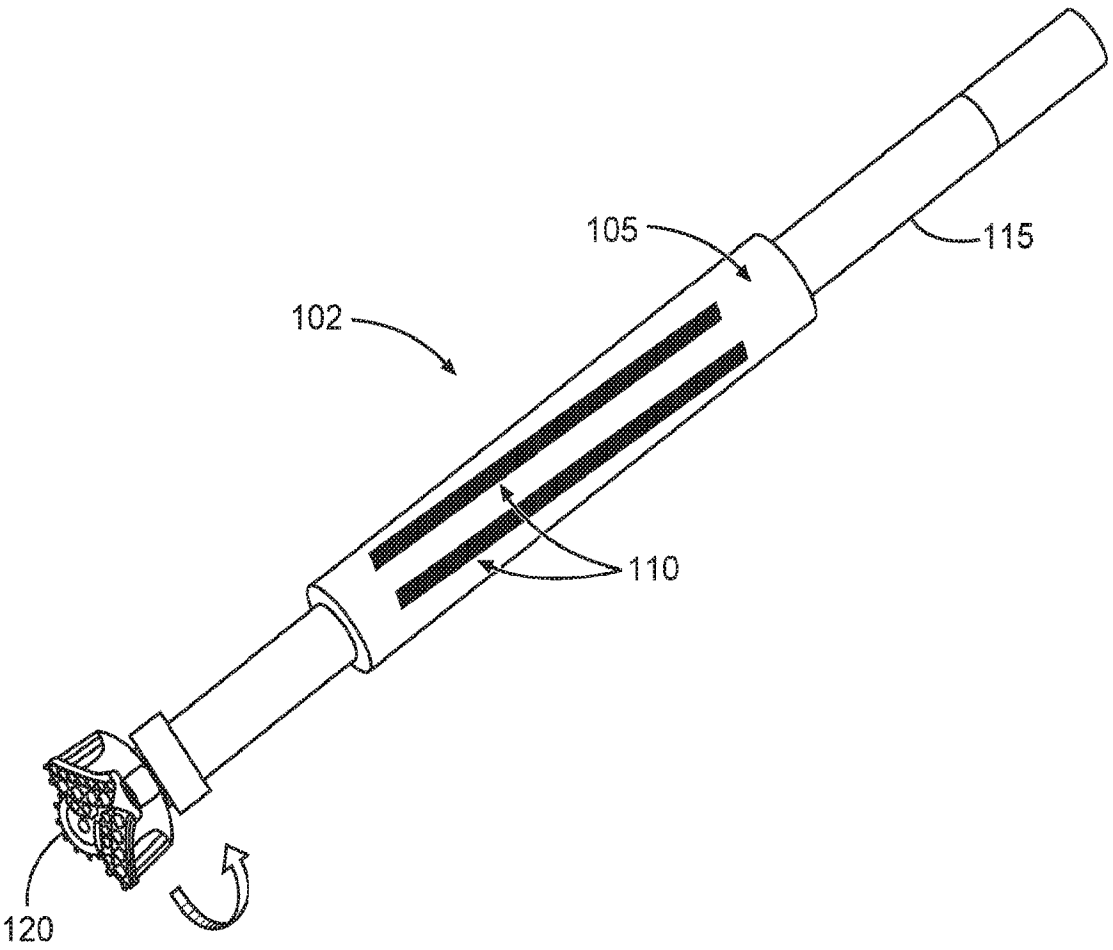
FIG. 1 is a schematic representation of an example non-rotating drill-in packer, in accordance with various embodiments.

FIG. 1 is a schematic representation of an embodiment of an example non-rotating drill-in packer 102. The non-rotating drill-in packer 102 can comprise a sleeve 105 structured to fit over a liner or a casing 115 and can be positioned above a drill bit 120 for the liner 115. The sleeve 105 can include annular expandable packer elements 110 such that the sleeve 105 can be operationally non-rotating. An expandable packer element herein is a packer element that moves out from a reference surface to which it is disposed. Such an expandable packer element can be realized by, but not limited to, an inflatable packer, a compression-type packer where the elements are squeezed to deform outwardly, a swell packer element that expands when exposed to certain fluids, and other equivalent packers. At a selected location in a wellbore, one of more of the annular expandable packer elements can be expanded to press against a wall of the wellbore holding the sleeve 105 in a non-rotating position, while liner 115 can be rotated. It is also noted that if the liner 115 and sleeve 105 become essentially stuck at a location in the borehole, sleeve 105 will be contacting the formation material causing the stuck condition, allowing the liner 115 to rotate. The liner 115 rotating with the sleeve 105 non-rotating can be facilitated by bearings or bushings between the sleeve 105 and the liner 115. A bearing, as used herein, is a mechanical structure that allows free rotation of a moving part around a fixed axis. Use of a bearing can provide for reduced friction. There are a number of types of bearings such as ball bearings, roller bearings, ball thrust bearings, roller thrust bearings, tapered roller bearings, and needle bearings. A bushing typically is structured to operate with a sliding motion between moving surfaces. A bushing is also referred to as a plain bearing, plane bearing, or sleeve bearing.

The sleeve 105 can be realized as a cylindrical structure with an opening along a longitudinal axis of the sleeve 105 that is sized such that the liner 115 is operable within the sleeve 105. The sleeve 105 may have a length that is a portion of the length of a typical liner section, which may be in the range of 30 ft to 40 ft or other lengths of liners. The sleeve 105 may extend the length of the liner section. The sleeve 105 may be positioned above the drill bit 120 using key slots in conjunction with a bearing to hold the sleeve 105 in a position relative to the liner 115, but allow the liner 115 to freely rotate.

The packer elements 110 can be arranged to extend from near one end of the sleeve 105 to an opposite end of the sleeve 105 as shown in FIG. 1. The packer elements 110 can be arranged in an axial position relative to the sleeve 105. An axial position is a position parallel to the longitudinal axis of the sleeve 105. The number of packer elements 110 can be selected to be spaced around the sleeve 105 such that, when expanded, the packer elements press against a wellbore providing a 360° seal with respect to sealing regions below the packer elements 110 from regions above the packer elements 110. Alternatively, the packer elements can be arranged in a horizontal position with respect to the axis of the sleeve 105 to provide the desired sealing function when expanded. In addition, the packer elements 110 may be arranged in other orientations that provide a 360° seal with respect to sealing regions below the packer elements from regions above the packer elements 110. For example, the packer elements 110 may be realized as a single packer attached to sleeve 105 such that the single packer is arranged substantially completely around the sleeve 105. Such a single packer can be disposed from near the top of the sleeve 105 to near the bottom of the sleeve 105. Alternatively, the single packer may extend a shorter distance along the longitudinal axis of the sleeve 105. This shorter single packer can be disposed centrally with respect to the length of the sleeve 105. Another structural arrangement can include a set of packers, with each packer of the set arranged substantially completely around the sleeve, the packers of the set disposed along the longitudinal axis of the sleeve 105 with the packers of the set arranged in series with a distance between each packer.

Figure 2:
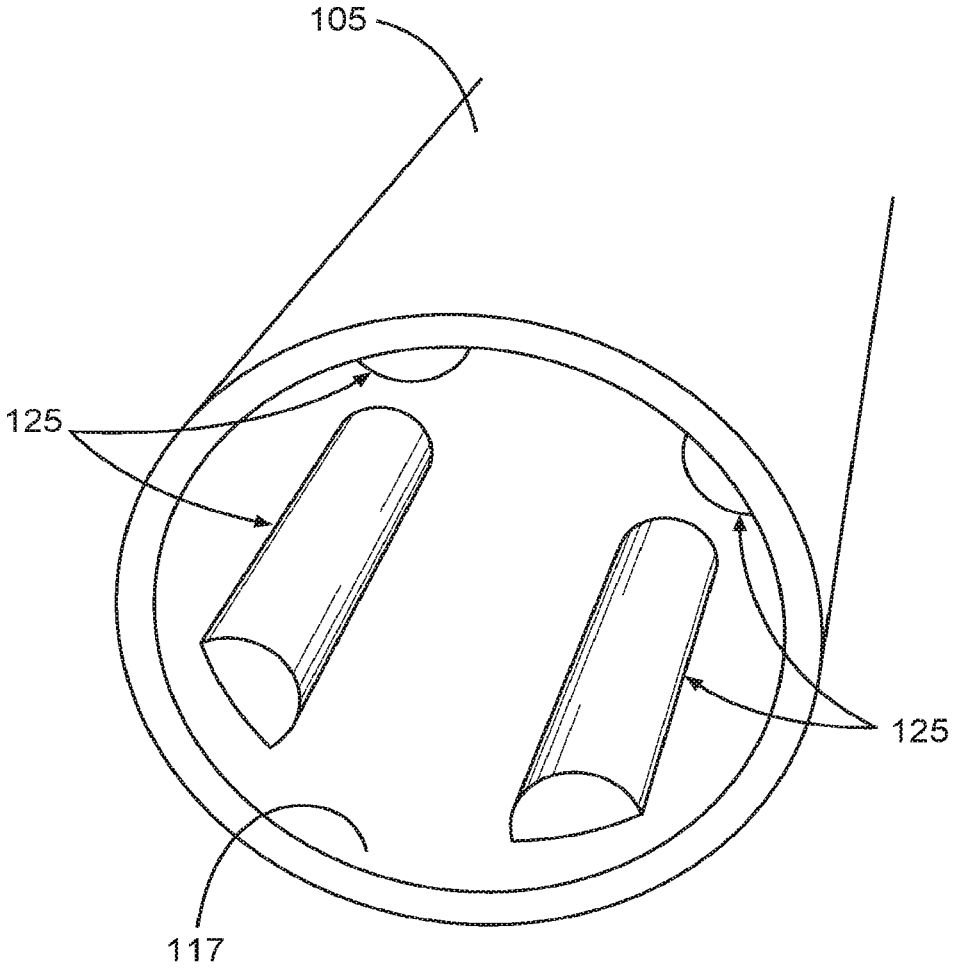
FIG. 2 is a schematic representation of the sleeve of FIG. 1 with bearing elements fixed to the inner surface of the sleeve, in accordance with various embodiments.

FIG. 2 shows the sleeve 105 of FIG. 1 with bearing elements 125 fixed to the inner surface 117 of the sleeve 105. The bearing elements may be fixed to the outer surface of liner 115 of FIG. 1. The bearing elements 125 allow the liner 115 of FIG. 1 to rotate freely within the sleeve 105 when the sleeve 105 is in a non-rotating position. The bearing elements 125 can be realized as needle bearings. A needle roller bearing can be realized as a bearing that uses small cylindrical rollers. The bearing elements 125 can be selected to have a radius sized to allow the liner 115 to be fitted within the sleeve 105 including the bearing elements 125. Bushings can be used rather than bearings, since bushings are more forgiving than bearings in a drilling environment, where drilled cuttings and barite are abrasive. The sleeve 105 having the bearing elements 125 (and/or bushings) can be structured with an outer diameter that is less than the effective diameter of the drill bit 120 of FIG. 1.

Figure 3:
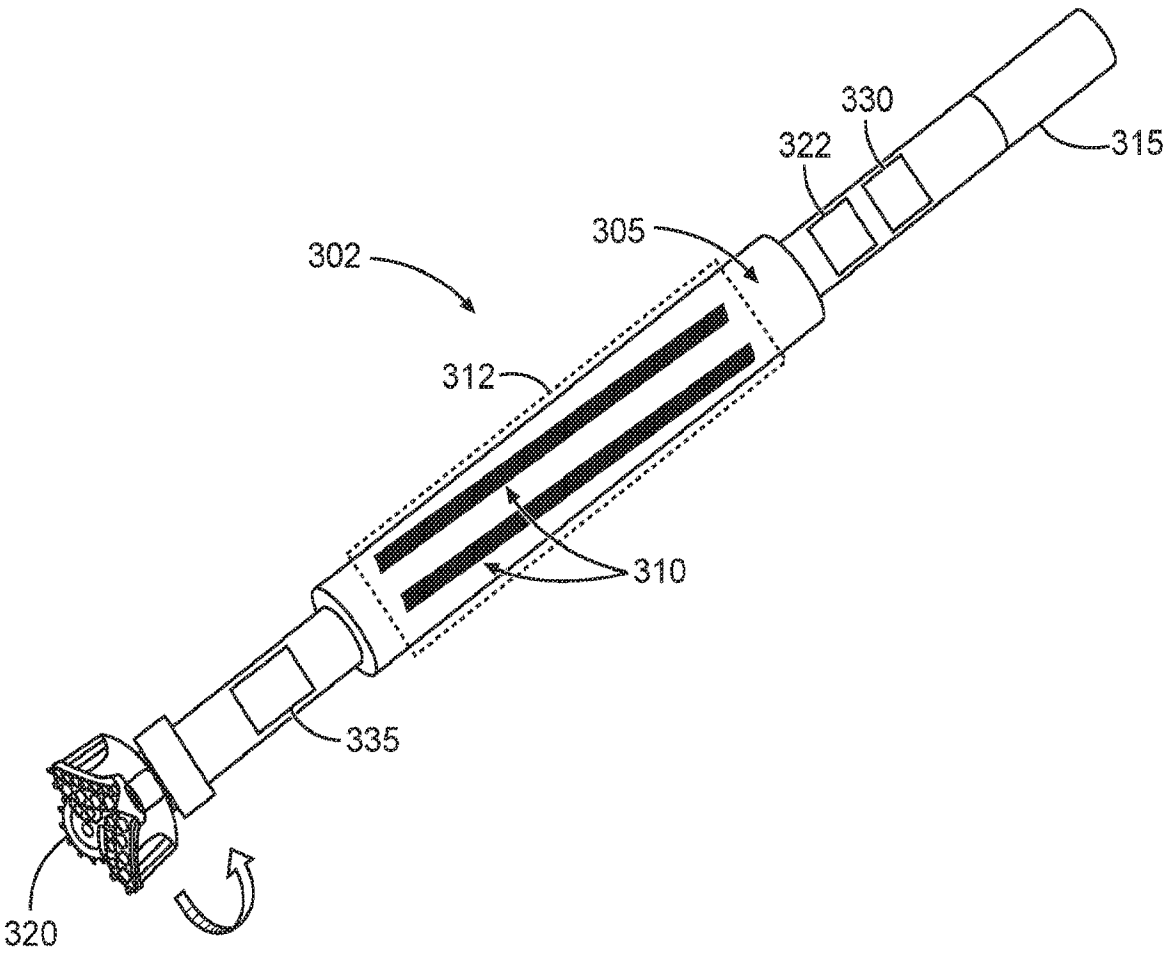
FIG. 3 is a schematic representation of an example non-rotating drill-in packer arranged with a stage collar, in accordance with various embodiments.

FIG. 3 is a schematic representation of an embodiment of an example non-rotating drill-in packer 302 arranged with a stage collar 330. The drill-in packer 302 can be structured, similar or identical to the drill-in packer 102 of FIG. 1, having a sleeve 305 to fit over a liner 315, where the sleeve 305 can be positioned above a drill bit 320 for the liner 315. The sleeve 305 can include annular expandable packer elements 310 such that the sleeve 305 can be operationally non-rotating. The stage collar 330 can be positioned above the sleeve 305 and can include one or more openings through which cement can flow into a region between the liner 315 and a formation. With the liner pressed against the formation or with the packer elements 310 expanded against the formation, the sleeve 305 can be held in a non-rotating position as the liner is rotated. With the liner rotating, cement can be dispensed through the one or more openings of the stage collar 330 such that cement can be provided in a complete 360 degree region around the liner 315, between the liner 315 and the surrounding formation and above the sleeve 305. Tubing to deliver cement can be used in lieu of the stage collar 330. Optionally, a stage collar 335 can be located below the sleeve 305 to allow the dispensing of cement in a complete 360 degree region around the liner 315, between the liner 315 and the surrounding formation and below the sleeve 305. Tubing to deliver cement tubing can be used in lieu of the stage collar 335.

The packer elements 310 can be arranged similar or identical to the packers 110 of FIG. 1. The packer elements 310 can be arranged in an axial position relative to the sleeve 305. An axial position is a position parallel to the longitudinal axis of the sleeve 305. The number of packer elements 310 can be selected to be spaced around the sleeve 305 such that, when expanded, the packer elements press against a wellbore providing a 360° seal with respect to sealing regions below the packer elements 310 from regions above the packer elements 310. The seal is 360° in that at there is a seal around the sleeve 305 though not necessarily in a horizontal orientation. Alternatively, the packer elements can be arranged in a horizontal position with respect to the axis of the sleeve 305 to provide the desired sealing function when expanded. In addition, the packer elements 310 may be arranged in other orientations that provide a 360° seal with respect to sealing regions below the packer elements from regions above the packer elements 310. For example, the packer elements 310 may be realized as a single packer 312 (the region between the dashed lines shown in FIG. 3) attached to sleeve 305 such that the single packer 312 is arranged substantially completely around the sleeve 305. Such a single packer 312 can be disposed from near the top of the sleeve 305 to near the bottom of the sleeve 305. Alternatively, the single packer 312 may extend a shorter distance along the longitudinal axis of the sleeve 305. This shorter single packer 312 can be disposed centrally with respect to the length of the sleeve 305. Another structural arrangement can include a set of packers, with each packer of the set arranged substantially completely around the sleeve, the packers of the set disposed along the longitudinal axis of the sleeve 305 with the packers of the set arranged in series with a distance between each packer.

A procedure to expand the packer elements 310 (also applicable to single packer 312) at the desired time to isolate the two zones, the high pressure zone and the low pressure zone, can include dropping a ball from the surface such that it lands on a valve seat within the sleeve 305 at the packer elements 310, blocking pressure from extending towards the drill bit 320. Once the ball is disposed on the valve seat, pressure in the casing 315 can be increased. The increased pressure can be conveyed to the packer elements 310 via a port extending from inside the sleeve 305 to the packer elements 310, which would activate the setting of the packer to inflate or expand the packer elements 310 to seal against the wall of the wellbore in which is it located. The pressure increase would correspond to a pressure threshold to activate the packer elements 310 based on the type of packer implemented. Once the packer is set, the pressure can be further increased such that the valve seat and the ball would shear release and move down into a larger diameter area to reestablish a flow path to allow circulation.

A procedure to expand the packer elements 310 (also applicable to packer 312) at the desired time to isolate the two zones, the high pressure zone and the low pressure zone, can include a communication device and an activation device. The communication device and an activation device may be integrated as an activation module 322 or the communication device and the activation device can be structured as individual components. The activation device can be implemented with a number of different mechanisms. An activation device can be realized as a valve type arrangement. The valve can be activated to close the valve, allowing pressure to be built-up, which would set the packer elements 310 to inflate or expand the packer elements 310 to seal against the wall of the wellbore, in response to a signal received by the communication device of the activation module 322. The activation device can include a piston. Another approach can include the activation device structured as a hydrostatic system, where in response to a signal received by the communication device of the activation module, a hydrostatic piston is released, which would set the packer elements 310 to inflate or expand the packer elements 310 to seal against the wall of the wellbore. For the various types of activation devices, the pressure applied can correspond to a pressure threshold to activate the packer elements 310 based on the type of packer implemented. The activation module 322 can be located in the sleeve 305, attached to the packer elements 310, or disposed within the vicinity of the packer elements 310. These activation approaches can be used with other packer/sleeve arrangements such as but not limited to the packer 110 and sleeve 105 arrangement of FIG. 1.

Figure 4:
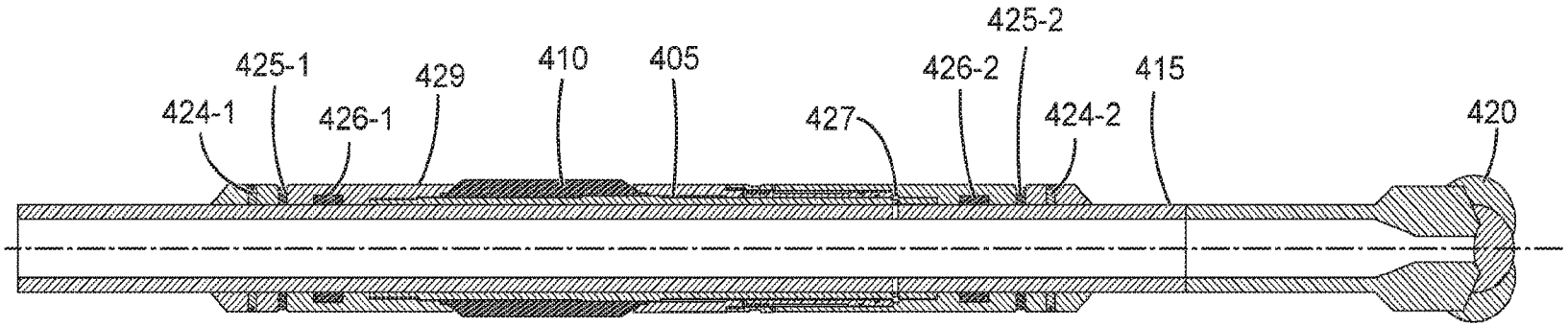
FIG. 4 is a schematic representation of an example embodiment of an example non-rotating drill-in packer, in accordance with various embodiments.

FIG. 4 is a schematic representation of an example embodiment of an example non-rotating drill-in packer 402. The non-rotating drill-in packer 402 can comprise a sleeve 405 structured to fit over a liner or a casing 415 and can be positioned above a drill bit 420 for the liner 415. The sleeve 405 can include one or more packer elements 410 operable to allow the sleeve 405 to be operationally non-rotating while the liner/casing 415 rotates. The one or more packer elements 410 are maintained within surface 429 as the sleeve 405 and the liner/casing 415 rotate. At a selected location in a wellbore, one of more of the expandable packer elements 410 can be expanded to press against a wall of the wellbore holding the sleeve 405 in a non-rotating position, while liner 415 can be rotated. It is also noted that if the liner 415 and sleeve 405 become essentially stuck at a location in the borehole, the sleeve 405/packer elements 410 will be contacting the formation material that causes the stuck condition, allowing the liner 415 to rotate.

The sleeve 405 can be realized as a structure with an opening along a longitudinal axis of the sleeve 405 that is sized such that the liner 415 is operable within the sleeve 405. Anchor screws 424-1 and 424-2 can be used to anchor the sleeve 405/packer 410 to the liner 415. Other types of anchor devices can be used such as a collet or slip, which is a gripping device that typically has a teeth structure. Thrust bushing/bearing elements 425-1 and 425-2 and lateral bushing/bearing elements 426-1 and 426-2 allow the liner 415 to rotate while drilling. Thrust bearings allow the liner or the casing 415 to rotate when a thrust load is applied to the sleeve 405. Piston 427 is operable in the setting of the packer element 410 against a wall of a wellbore.

Figure 5:
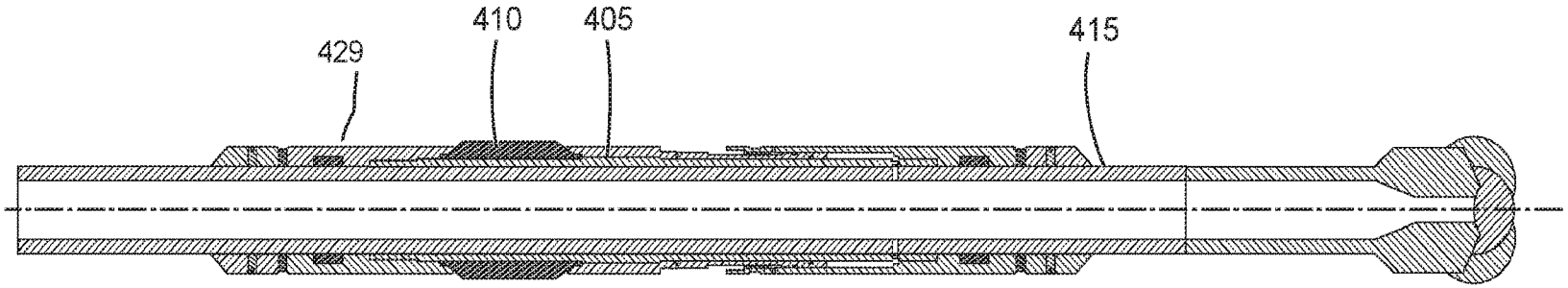
FIG. 5 is a schematic representation of non-rotating drill-in packer of FIG. 4 with a packer element expanded, in accordance with various embodiments.
Figure 6:
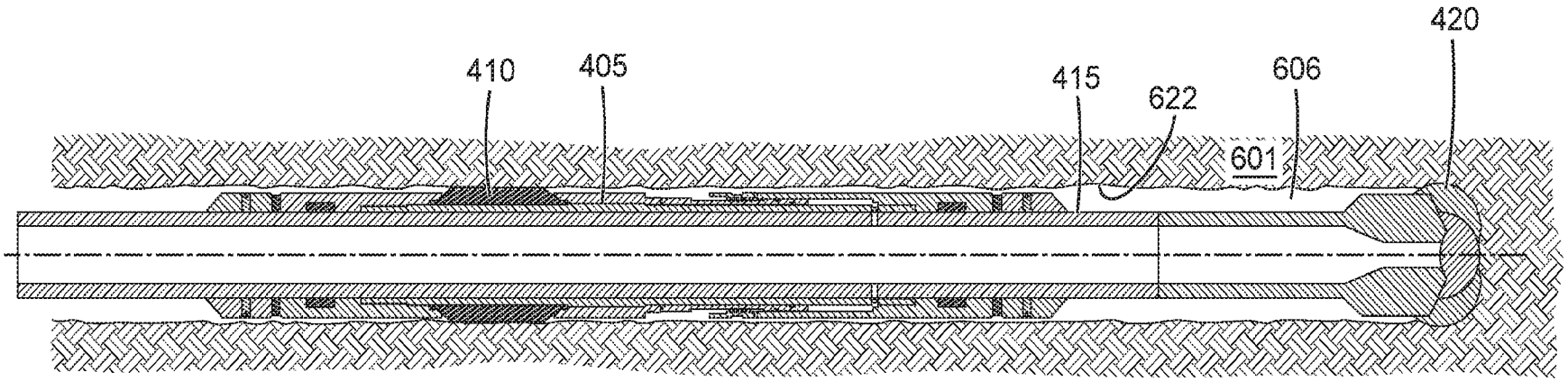
FIG. 6 is a schematic representation of the non-rotating drill-in packer of FIG. 4 with a packer element set against a wall of a borehole in a formation, in accordance with various embodiments.

FIG. 5 is a schematic representation of non-rotating drill-in packer 402 of FIG. 4 with packer element 410 expanded. In the expanded position, packer element 410 extents above surface 429. FIG. 6 is a schematic representation of the non-rotating drill-in packer 402 of FIG. 4 with packer element 410 set against a wall 622 of a borehole 606 in a formation 601. FIG. 6 shows that as the packer's element is set (squeezed) at the wall 622, it will grip the sleeve 405 and prevent the sleeve 405 from rotating, while liner/casing 415 can rotate.

Figure 7:
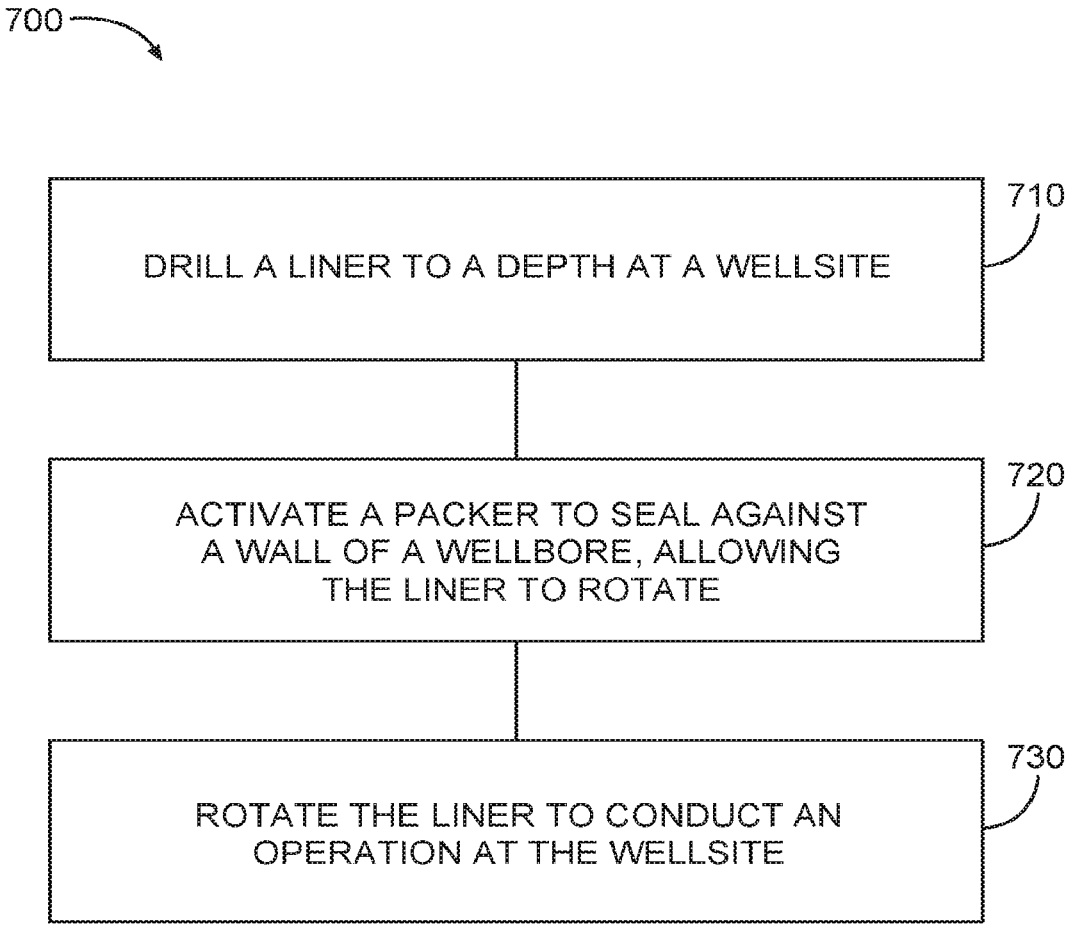
FIG. 7 is a flow diagram of features of a method that implements a non-rotating drill-in packer, in accordance with various embodiments.

FIG. 7 is a flow diagram of features of a method 700 that implements a non-rotating drill-in packer. The non-rotating drill-in packer may include features similar to or identical to features associated with the apparatus of FIGS. 1-6. At 710, a liner is drilled to a depth at a well site. At 720, a packer is activated to seal against a wall of a wellbore, allowing the liner to rotate. The activated packer can seal off a region below the packer. The activated packer can be arranged as an element of a sleeve fitted around the liner, the sleeve structured to allow the liner to rotate with the sleeve non-rotating. The packer can be a packer of the non-rotating drill-in packer arranged to seal off a region below the annular expandable packer elements from the above hydrostatic well column in the wellbore. Activating the packer to seal against the wall of the wellbore and sealing off the region below the packer can include activating a plurality of packers to seal against the wall of the wellbore and to seal off the region below the packer.

At 730, the liner is rotated to conduct an operation at the well site. The operation can include rotating the liner with non-rotating drill-in packer sealing off the region when pumping a fluid. The fluid or fluids can include: cement, drilling mud, space fluids (fluids pumped between drilling mud and cement to prevent the drilling mud from contaminating the cement), specialized fluids to remove filter cake from the wellbore, fluids containing loss circulation materials to seal the wellbore and/or formation, water-based fluids, oil-based fluids (OBM), synthetic oil based muds (SBM) etc. Pumping the fluid may include pumping the fluid above the packer. Pumping the fluid may include pumping the fluid below the packer. Additionally, pumping the fluid may include pumping the fluid below the packer and then pumping fluid above the packer, or vice-versa. The operation may include using one or more additional packers. Pumping the fluid can include pumping fluid with respect to one or more additional packers; and pumping fluid above the one or more additional packers or pumping fluid below the one or more additional packers. Pumping the fluid can include pumping fluid with a plurality of additional packers; and pumping fluid above one of the plurality of additional packers and pumping fluid below another one of the plurality of additional packers. Further, the method 700 can include setting a liner hanger after pumping the fluid. A liner hanger is a mechanism to attach liners from an inner wall of a previous casing string.

Method 700 or methods similar to method 700 can include controlling the opening and closing of a port through which the fluid flows using a sensor arranged to sense presence of a device or sense a parameter associated with an environment in which the sensor is disposed. The sensor can be arranged to sense a plug as the plug passes the sensor. The sensor can be arranged to sense pressure in a pressure range for a specified time. The sensor can be arranged to, but is not limited to, sensing a pressure of about 3000 psi being held for about 5 minutes.

Figure 8:
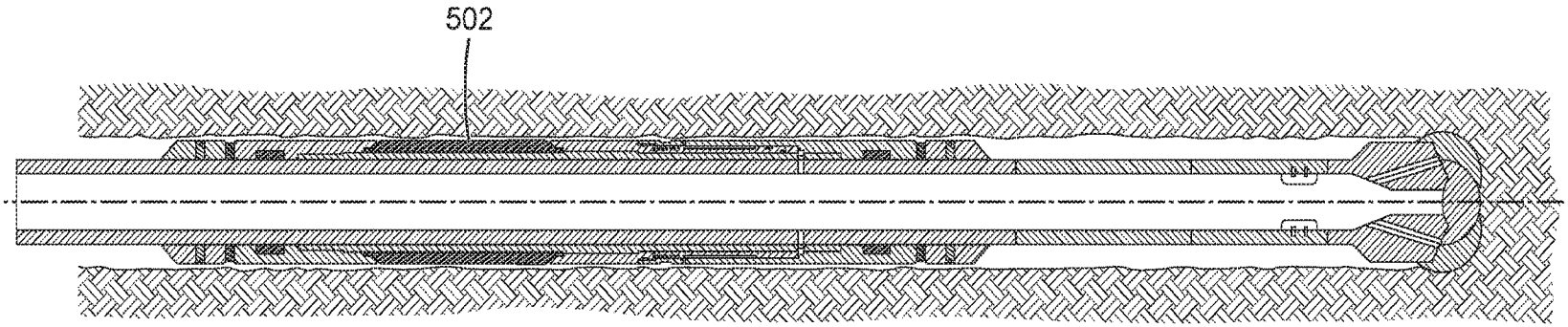
FIGS. 8-18 are illustrations related to a method for cementing upper sections with respect to a liner/casing, in accordance with various embodiments.
Figure 9:
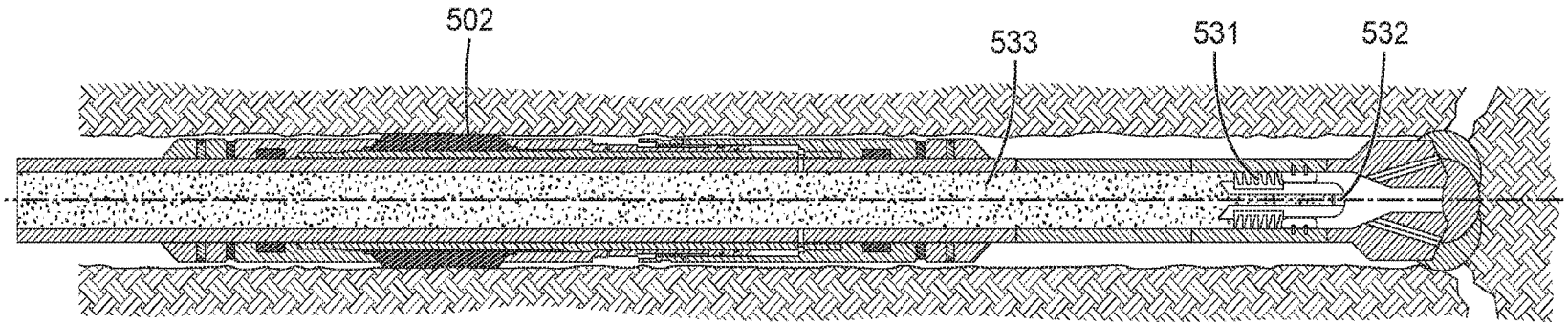

FIGS. 8-18 are illustrations related to a method for cementing upper sections with respect to a liner/casing. A non-rotating drill-in packer, similar or identical to the non-rotating drill-in packer of FIGS. 4-6, may be used. FIG. 8 is an illustration of a non-rotating drill-in packer 502 in drilling mode with the packer of the non-rotating drill-in packer 502 not set. FIG. 9 is an illustration of a lower wiper plug 531, having a membrane 532, and cement 533 pumped after the lower wiper plug has been dropped, pumped, or released. With circulation lost, rotating can continue slowly, for example at approximately 6-rpm, lower wiper plug 531 can be pumped down to land the lower wiper plug 531 below the packer, and pressure can be built up to set the packer of the non-rotating drill-in packer 502. Note that the lower wiper plug 531 can be pumped downhole either with drilling mud or cement. Pumping mud may present less risk in the event such as the hole collapses prior to the cement fully exiting the drill pipe. On the other hand, displacing the lower wiper plug 531 with cement requires less time to displace the plug than is required to displace the lower wiper plug 531 with drilling mud and then pumping cement.

Figure 10:
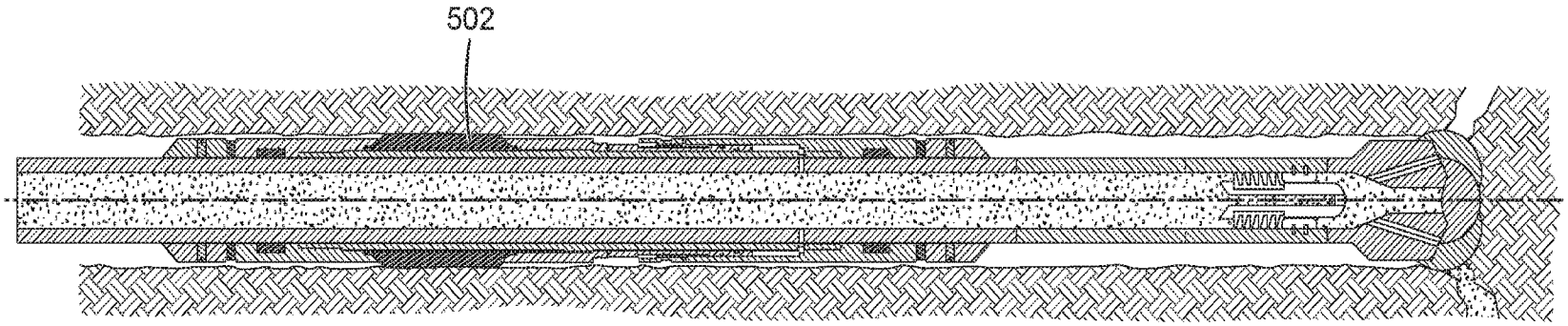

FIG. 10 is an illustration of the cement procedure after rupture of the membrane 532 of the lower wiper plug 531. After the packer is set, pressure up against the lower wiper plug 531 is continued until the internal membrane 532 of the lower wiper plug 531 bursts. Once the membrane 532 is broken, pumping of mud or cement can continue.

Figure 11:
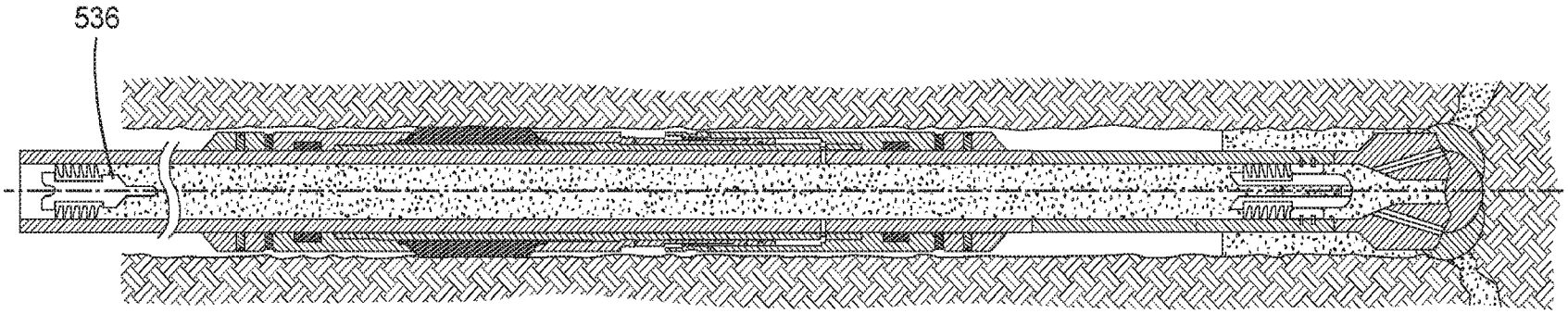

FIG. 11 is an illustration of displacing cement with an upper wiper plug 536. After the preferred volume of cement is mixed and pumped down the drill pipe, the upper wiper plug 536 can be dropped behind the cement. Then, the upper wiper plug 536 and cement are pumped the rest of the way down the drill pipe by pumping drilling mud behind the upper wiper plug 536.

Figure 12:
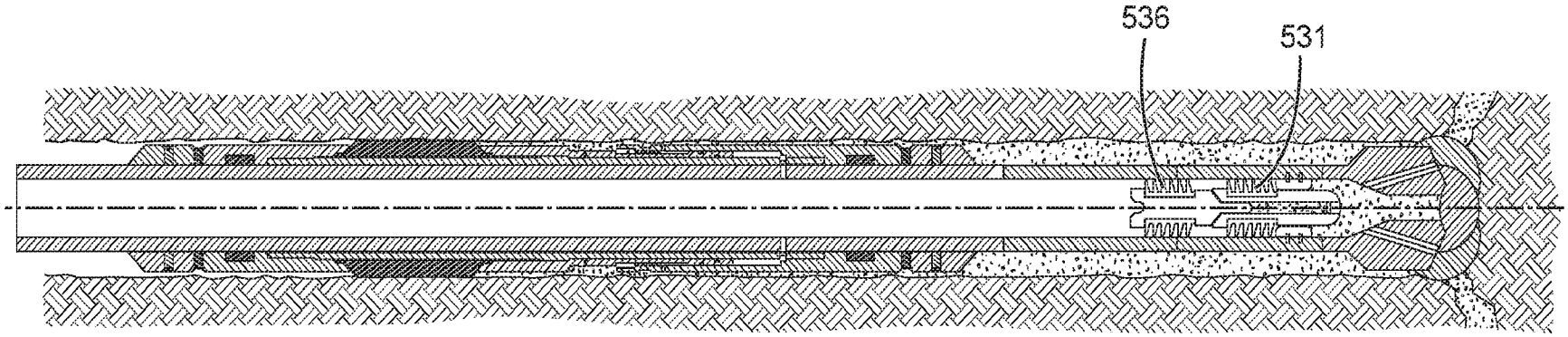

FIG. 12 is an illustration of a lowest interval being cemented. Once enough drilling mud has been pumped to displace the upper wiper plug 536 to the bottom of the liner, the upper wiper plug 536 can seat against the topside of the lower wiper plug 531. As with the operation in FIG. 9, this operation can be conducted with a packer set. Some operators may prefer to set the packer after the cement has been set. This can be achieved by using a lower wiper plug with a low breaking strength membrane, that is, low enough that the packer won't set, for example 500-psi to 1,000-psi. Then, after the upper wiper plug 536 has landed on top of the lower wiper plug 531, the pressure would be increased enough to set the packer, for example, from approximately 2,000-psi to 3,000-psi.

Figure 13:
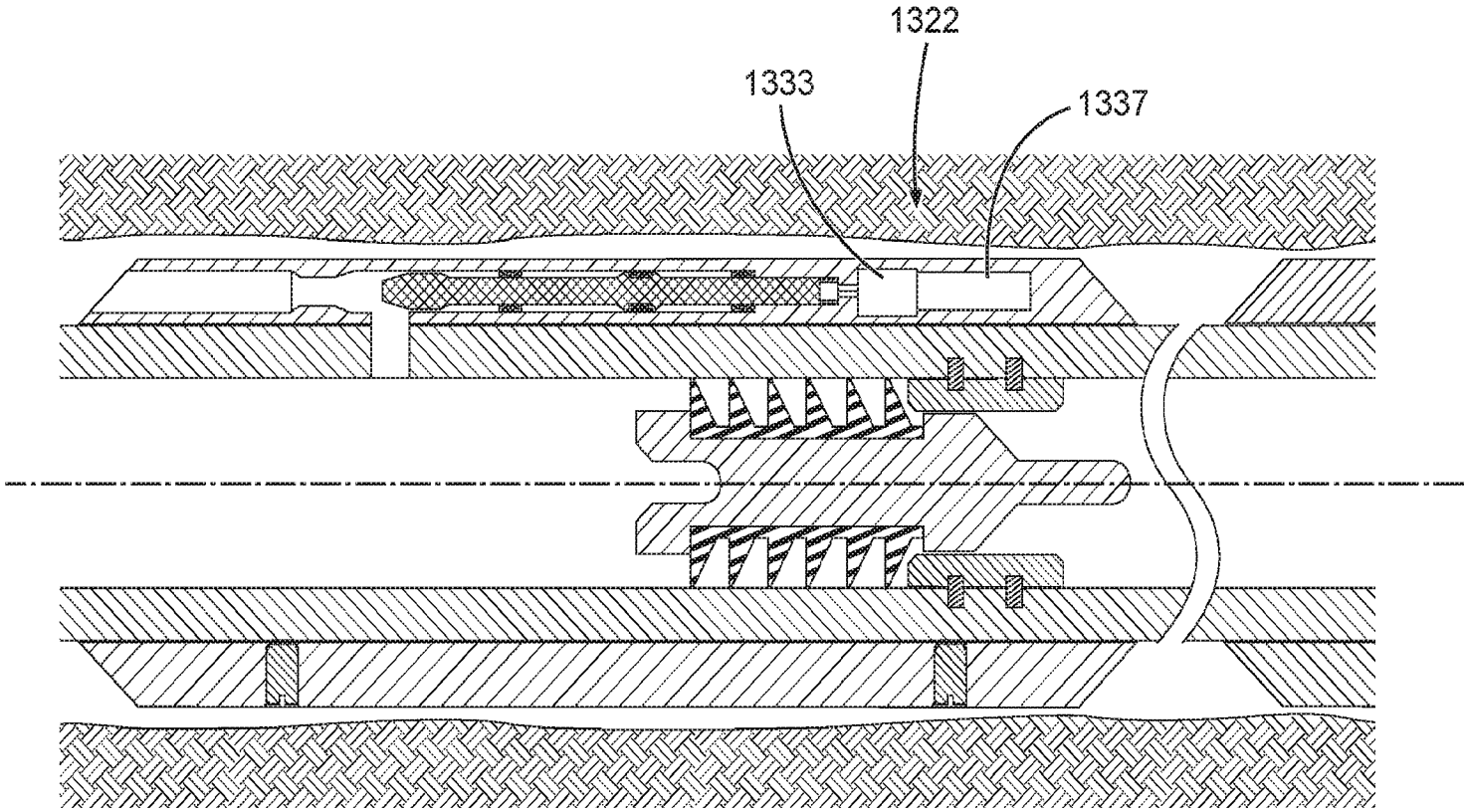

FIG. 13 is an illustration of a module 1322 to open a cement port. This module is similar to activation module 322 of FIG. 3. Module 1322 is not limited to open a cement port, but can open a port for other fluids to flow. The fluids can include: cement, drilling mud, space fluids (fluids pumped between drilling mud and cement to prevent the drilling mud from contaminating the cement), specialized fluids to remove filter cake from the wellbore, fluids containing loss circulation materials to seal the wellbore and/or formation, water-based fluids, oil-based fluids (OBM), synthetic oil based muds (SBM) etc. Module 1322 has an actuator 1333 and a sensor 1337 that senses a "first" upper wiper plug, such as upper wiper plug 536, that was dropped in the previous step as it passes by module 1322. The activation module 1322 may wait until the first upper wiper plug, such as upper wiper plug 536, has landed against the first lower wiper plug, such as upper wiper plug 531, and has also sensed an increase of pressure.

Figure 14:
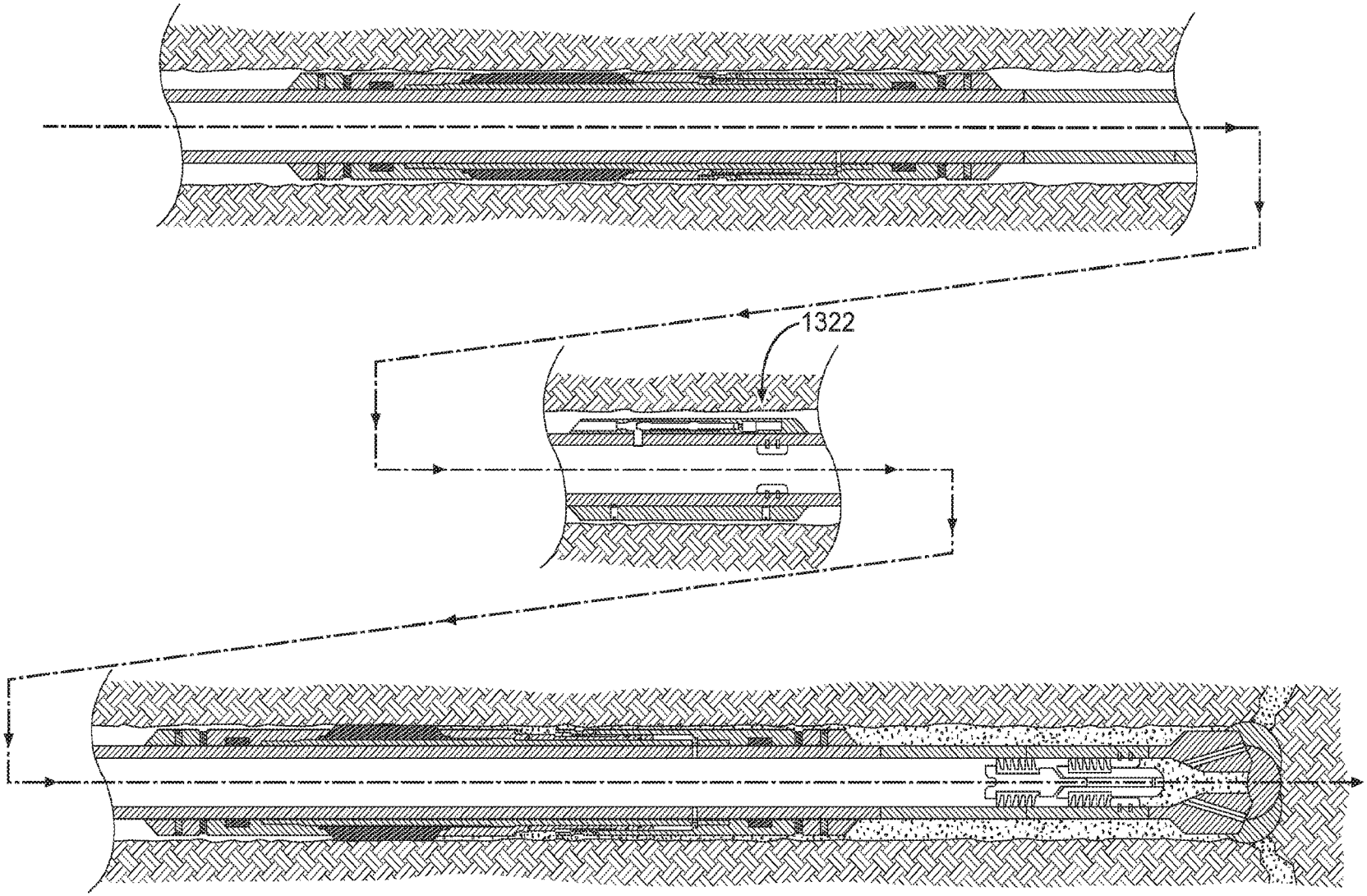
Figure 15:
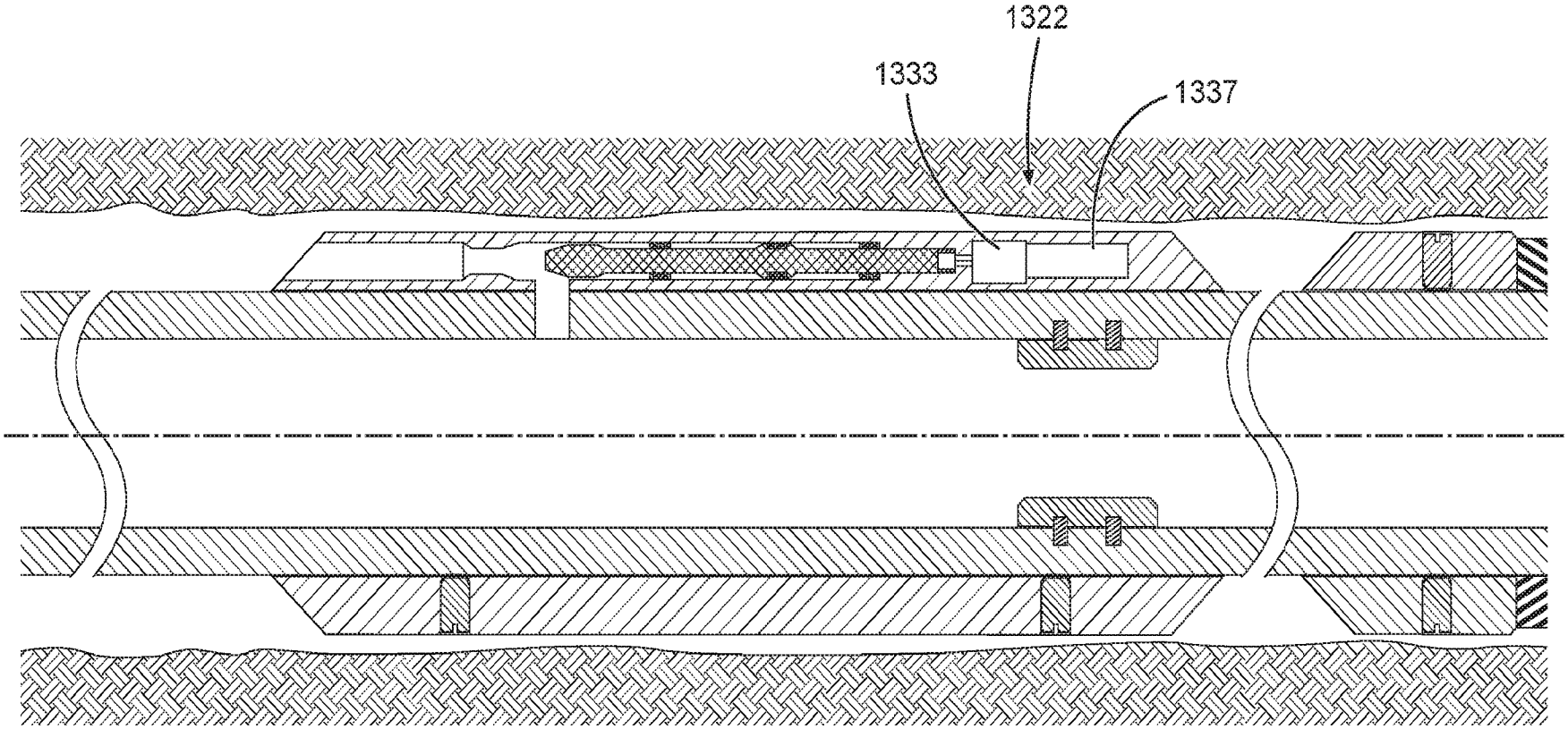

FIG. 14 is an illustration of a module 1322 opening a cementing port. The particular pressure range that the activation module 1322 is waiting for may be in the range of 3,200-psi to 3,500-psi, as an example. The activation module 1322 may also be set to require that pressure range to be held for a particular time frame, for example, 3 to 5 minutes. If this module does not sense the 3,200-psi to 3,500-psi pressure range for 3 to 5 minutes, it may be programmed to not open the cementing port. If it does sense the proper set of parameters, the module will open the cementing port and another section of the wellbore (for example, the wellbore section above the previous set packer) can be cemented. FIG. 15 is a close-up of the module 1322 with actuator 1333 and sensor 1337 in the open position.

Figure 16:
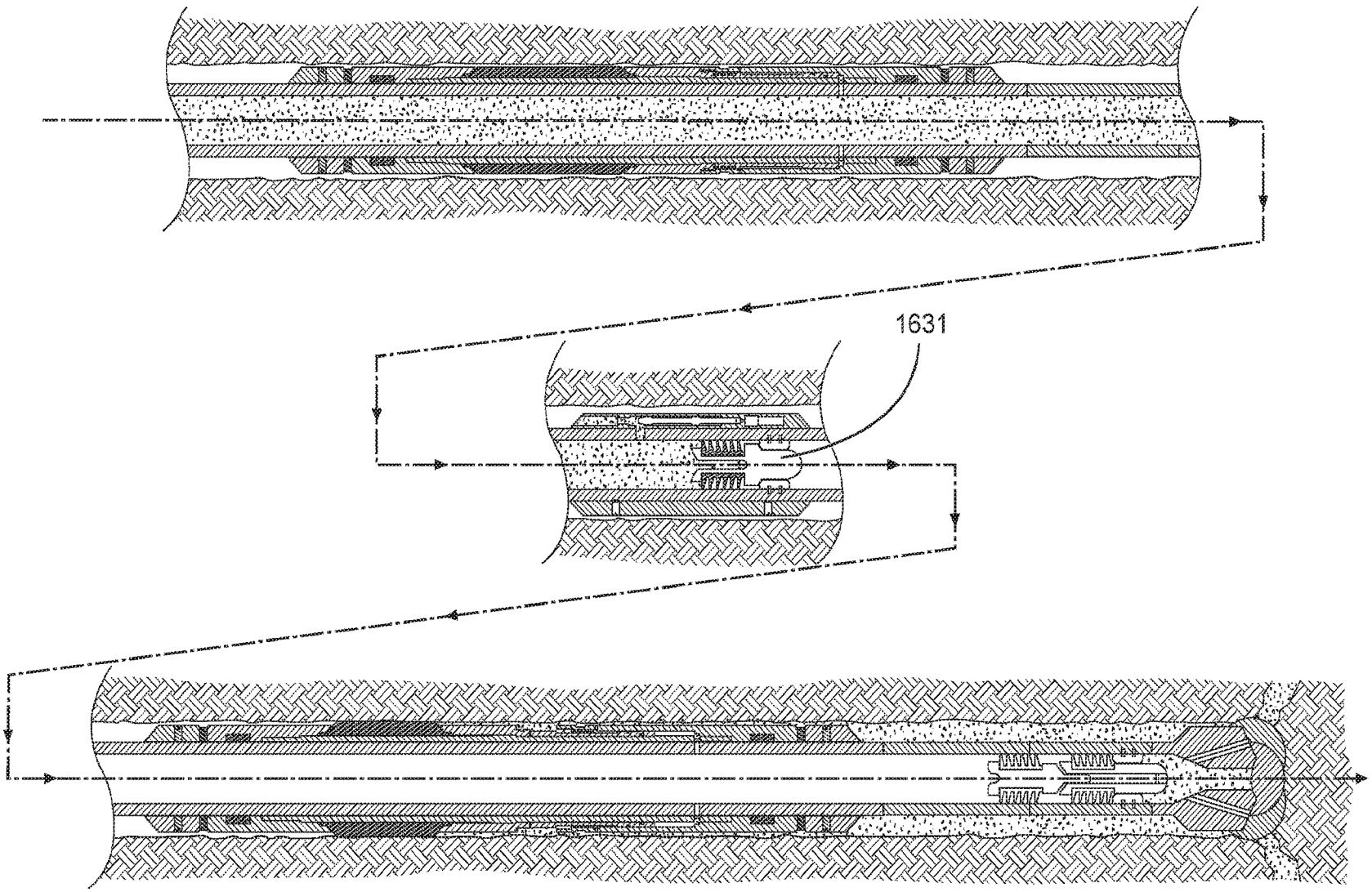

FIG. 16 is an illustration of pumping cement. When the module opens the cementing port, a second lower wiper plug 1631 may be installed in the liner and displaced to the cementing port by cement. The second lower wiper plug 1631 can be dropped followed by cement. The second lower wiper plug 1631 can land just below the module and the cement port.

Figure 17:
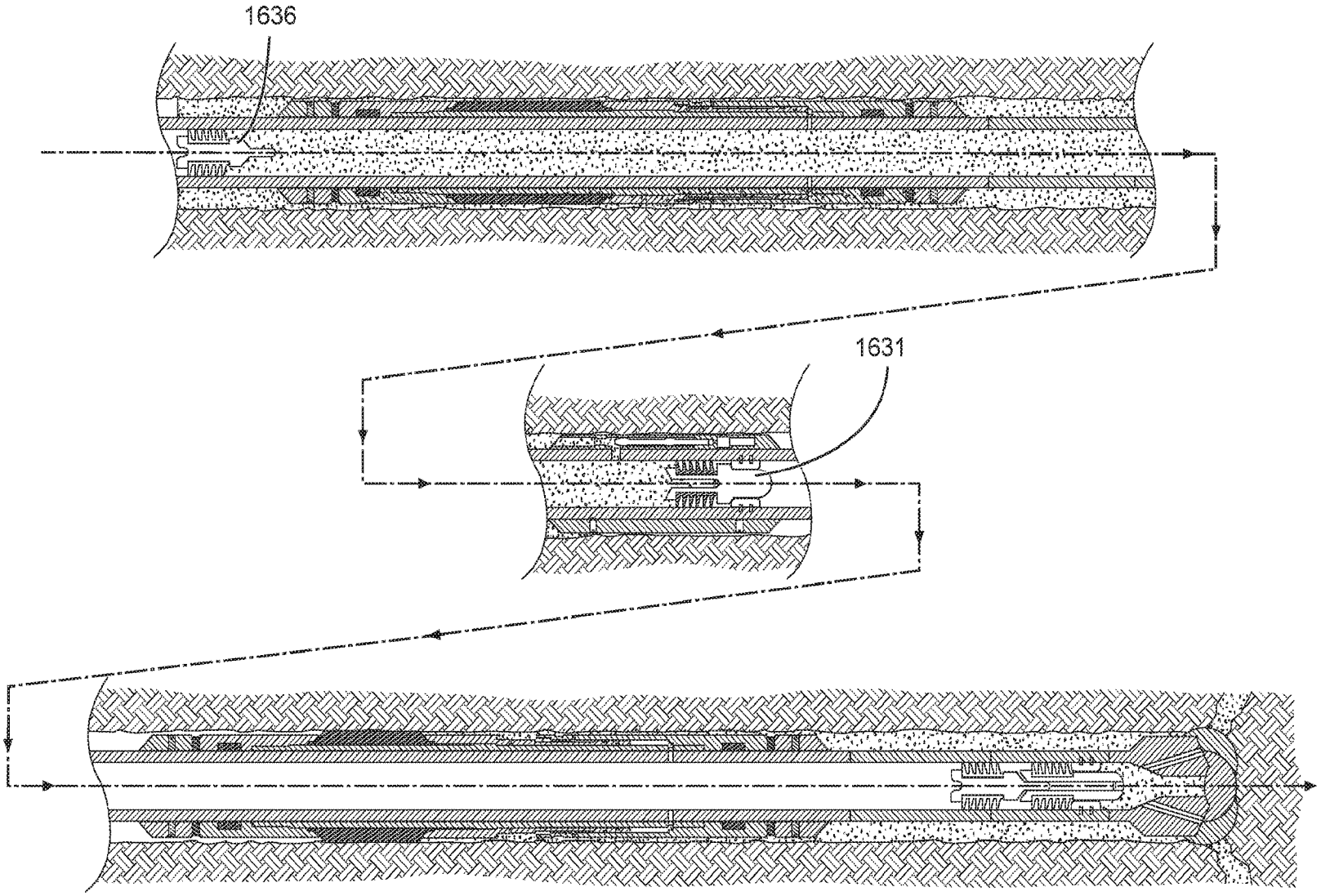

FIG. 17 is an illustration of displacing cement with second upper wiper plug 1636 and drilling mud. The upper wiper plug 1636 is installed. The upper wiper plug 1636 and cement are pumped down hole with drilling mud. As illustrated in FIG. 17, the actual amount of cement pumped may be too much for a particular interval. However this is not a problem because the excess cement can pass through the packer/open hole annulus and partially fill the next section. This is acceptable as long as the next packer is set and the next cement port is opened before the cement has time to thicken to a point where the packer cannot squeeze its elements through the cement and/or drilling mud can be pumped through the next-to-opened cement port above.

Figure 18:
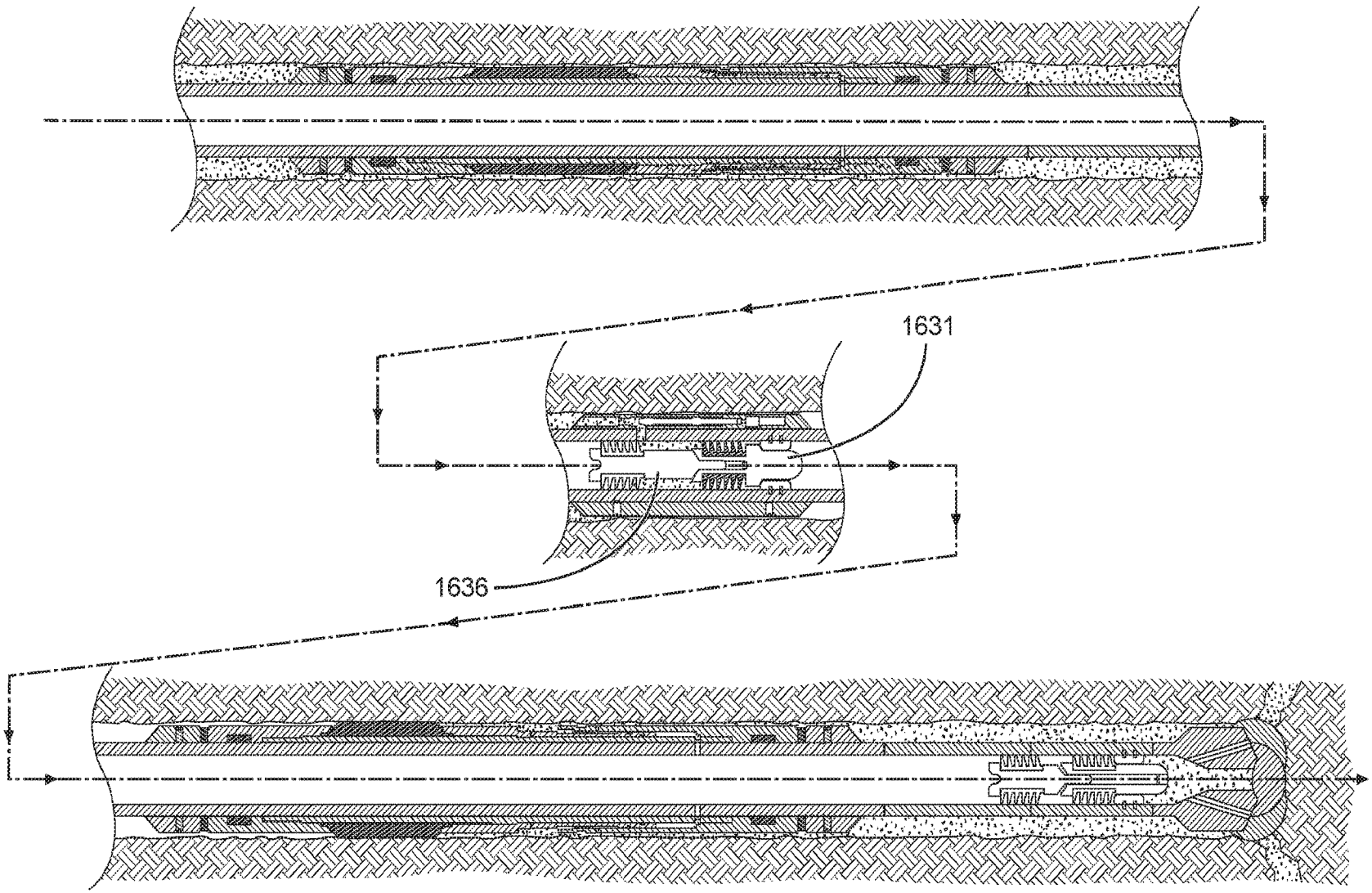

FIG. 18 is an illustration of second upper wiper plug 1636 having landed. Procedures associated with FIGS. 13-18 can be repeated to cement upper sections.

Non-rotating drill-in packers similar to or identical to the non-rotating drill-in packers taught herein provide alternative mechanisms to address the challenge of using an annular packer element and separate clutch mechanism above the packer, where methods that add such a clutch component typically have a relatively high potential for failing into addition to challenges to make such a structure.

Figure 19:
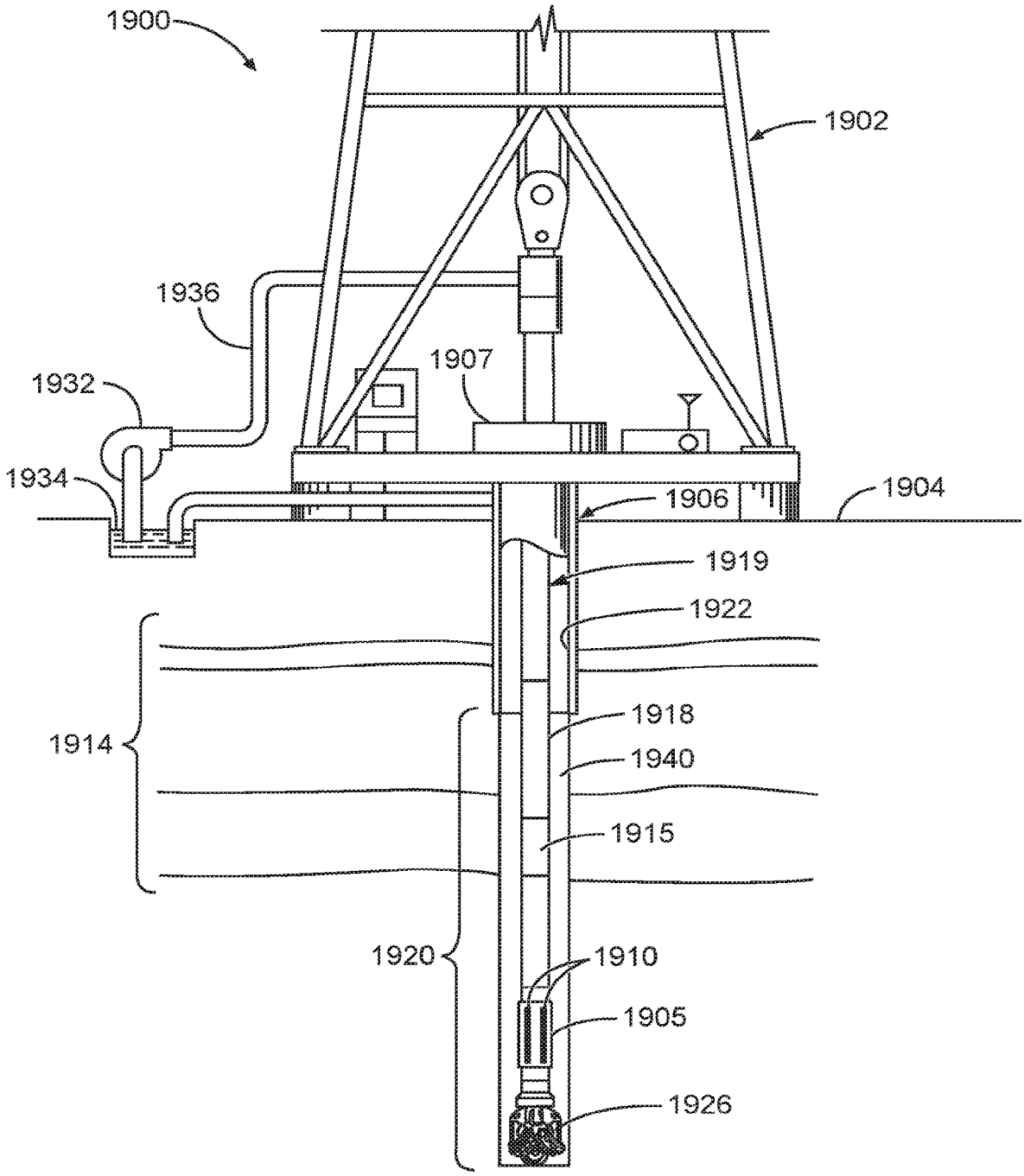
FIG. 19 is a schematic representation of an example system at a drilling site, where the system includes a sleeve having expandable packer elements such that the sleeve can fit over a component such that the sleeve can be operationally non-rotating, while the component rotates, in accordance with various embodiments.

FIG. 19 depicts an example embodiment of a system 1900 at a drilling site, where the system 1900 includes a sleeve 1905 having annular expandable packer elements 1910 such that the sleeve 1905 can fit over a component such that the sleeve can be operationally non-rotating, while the component rotates. The sleeve 1905 having annular expandable packer elements 1910 can be realized in a similar or identical manner to a non-rotating drill-in packer discussed herein and can be configured to operate in accordance with the teachings herein. The system 1900 can be arranged in a land based drilling operation or an offshore drilling operation.

The system 1900 can include a drilling rig 1902 located at a surface 1904 of a well 1906 and a string of drill pipes, that is, the drill string 1919, connected together so as to form a drilling string that is lowered through a rotary table 1907 into a wellbore (borehole) 1922. The drilling rig 1902 can provide support for the drill string 1919. The drill string 1919 can operate to penetrate rotary table 1907 for drilling a borehole 1922 through subsurface formations 1914. The drill string 1919 can include drill pipe 1918 and a bottom hole assembly 1920 located at the lower portion of the drill string 1919.

The bottom hole assembly 1920 can include drill collar 1915 and a drill bit 1926. The drill bit 1926 can operate to create the borehole 1922 by penetrating the surface 1904 and the subsurface formations 1914. The sleeve 1905 having annular expandable packer elements 1910 can be structured for an implementation in the borehole 1922 of a well to allow a liner to rotate with the sleeve 1905 in a non-rotating position.

During drilling operations, the drill string 1919 can be rotated by the rotary table 1907. In addition to, or alternatively, the bottom hole assembly 1920 can also be rotated by a motor (e.g., a mud motor) that is located downhole. The drill collars 1915 can be used to add weight to the drill bit 1926. The drill collars 1915 also can stiffen the bottom hole assembly 1920 to allow the bottom hole assembly 1920 to transfer the added weight to the drill bit 1926, and in turn, assist the drill bit 1926 in penetrating the surface 1904 and subsurface formations 1914.

During drilling operations, a mud pump 1932 can pump drilling fluid, which can be drilling mud, from a mud pit 1934 through a hose 1936 into the drill pipe 1918 and down to the drill bit 1926. A mud motor 1927 can be disposed above drill bit 1926 to create rotation for the drill bit. The drilling fluid can flow out from the drill bit 1926 and be returned to the surface 1904 through an annular area 1940 between the drill pipe 1918 and the sides of the borehole 1922. The drilling fluid may then be returned to the mud pit 1934, where such fluid is filtered. In some embodiments, the drilling fluid can be used to cool the drill bit 1926, as well as to provide lubrication for the drill bit 1926 during drilling operations. Additionally, the drilling fluid may be used to remove the subsurface formation 1914 cuttings created by operating the drill bit 1926.

A casing-drilling system or a liner-drilling system may be used in drilling environments where lost circulation, wellbore instability and/or other challenging conditions exist. In a casing-drilling system, bottom hole assembly (BHA) 1920 of FIG. 19 is replaced with an inner and outer string. The inner string typically consists of a drill bit, pilot BHA, an underreamer drive sub, a mud motor and other devices typically used to drill directional wells. The inner string is typically releasably attached to the outer string so that it can be withdrawn from the outer string once the system has reached the desired depth. The outer string typically consists of reamer bit (also known as underreamer bit) and casing. The casing typically extends to surface where it is rotated by the rig's rotary table, 1907. Drilling mud is pumped down the casing via hose 1936, through the casing and exits the drill bit.

A liner-drilling system is similar to the casing-drilling system except the liner does not extend back to the surface when the wellbore has reached the final depth. Likewise, drill pipe is used to rotate the liner-drilling system instead of casing. The inner string of a liner-drilling system typically consists of at least the following components: drill bit, pilot BHA, an underreamer drive sub, a landing sub, a mud motor and a liner running tool, which releases the inner string from the outer string. The outer string consists of an underreamer, liner, and liner hanger. Once the liner-drilling system has reached its final depth, the liner running tool is activated to anchor the liner hanger against the inside wall of a previous casing string. Then the inner string is retrieved from the wellbore.

An apparatus 1 can comprise: a sleeve structured to operatively fit over a liner or a casing in a wellbore; and packer elements disposed with the sleeve, wherein the sleeve with the packer elements is arranged such that the liner or the casing, having the sleeve disposed over the liner or casing, is capable of rotation within the sleeve when the sleeve with the packer elements is operationally non-rotating.

An apparatus 2 can include elements of apparatus 1 and can include the packer element packer element being one of a plurality of packer elements disposed in an annular arrangement in the sleeve and being expandable to press against a wall of the wellbore to hold the sleeve in a non-rotating position.

An apparatus 3 can include elements of any of apparatus 1 and 2 and can include the sleeve being positionable near and above a drill bit for the liner.

An apparatus 4 can include elements of any of apparatus 1-3 and can include the sleeve including bearings or bushings attached to an inner surface of the sleeve such that the bearings are between the sleeve and the liner or the casing when the sleeve is fitted over the liner or the casing, the bearings structured to allow the liner or the casing to rotate when the sleeve is non-rotating.

An apparatus 5 can include elements of any of apparatus 1-4 and can include the apparatus to include anchor devices to anchor the sleeve to the liner or the casing and bushings that allow the liner or the casing to rotate when the sleeve is non-rotating.

An apparatus 6 can include elements of any of apparatus 1-5 and can include the apparatus to include thrust bearings to allow the liner or the casing to rotate when a thrust load is applied to the sleeve.

An apparatus 7 can include elements of any of apparatus 1-6 and can include the apparatus to include a collar having an opening to dispense cement, the collar positionable above or below the sleeve.

An apparatus 8 can include elements of any of apparatus 1-7 and can include the apparatus to include the liner.

An apparatus 9 can include elements of any of apparatus 1-8 and can include the apparatus to include a communication device and an activation device arranged to operatively expand the packer element to press against a wall of the wellbore to hold the sleeve in a non-rotating position.

An apparatus 10 can include elements of any of apparatus 1-9 and can include the activation device to include a valve, a piston, or a hydrostatic piston.

An apparatus 11 can include elements of any of apparatus 1-10 and can include a module to open a port for fluid flow, the module having an actuator responsive to a sensor.

An apparatus 12 can include elements of any of apparatus 1-11 and can include the packer element being a packer attached to the sleeve such that the packer is disposed substantially completely around the sleeve.

A method 1 can comprise: drilling a liner to a depth at a well site; activating a packer to seal against a wall of a wellbore and sealing off a region below the packer, the packer being an element of a sleeve fitted around the liner, the sleeve structured to allow the liner to rotate with the sleeve non-rotating; and rotating the liner to conduct an operation at the well site.

A method 2 can include elements of method 1 and can include pumping a fluid while rotating the liner. The fluid or fluids can include: cement, drilling mud, space fluids (fluids pumped between drilling mud and cement to prevent the drilling mud from contaminating the cement), specialized fluids to remove filter cake from the wellbore, fluids containing loss circulation materials to seal the wellbore and/or formation, water-based fluids, oil-based fluids (OBM), synthetic oil based muds (SBM) etc.

A method 3 can include elements of any of methods 1 and 2 and can include setting a liner hanger after pumping the fluid.

A method 4 can include elements of any of methods 1-3 and can include pumping the fluid to include pumping the fluid above the packer.

A method 5 can include elements of any of methods 1-4 and can include pumping the fluid to include pumping the fluid below the packer.

A method 6 can include elements of any of methods 1-5 and can include pumping the fluid to include pumping fluid above the packer and pumping fluid below the packer.

A method 7 can include elements of any of methods 1-6 and can include pumping the fluid to include pumping fluid with respect to one or more additional packers; and pumping fluid above the one or more additional packers or pumping fluid below the one or more additional packers.

A method 8 can include elements of any of methods 1-7 and can include pumping the fluid to include pumping fluid with a plurality of additional packers; and pumping fluid above one of the plurality of additional packers and pumping fluid below another one of the plurality of additional packers.

A method 9 can include elements of any of methods 1-8 and can include activating the packer to seal against the wall of the wellbore and sealing off the region below the packer to include activating a plurality of packers to seal against the wall of the wellbore and to seal off the region below the packer.

A method 10 can include elements of method 2 and elements of any of methods 1 and 3-9 and can include controlling the opening and closing of a port through which the fluid flows using a sensor arranged to sense presence of a device or sense a parameter associated with an environment in which the sensor is disposed.

A method 11 can include elements method 10 and elements of any of methods 1-9 and can include the sensor to sense a plug as the plug passes within the vicinity of the sensor.

A method 12 can include elements method 10 and elements of any of methods 1-9 and 1 land can include the sensor to sense pressure in a pressure range for a specified time.

A method 13 can include elements method 12 and elements of any of methods 1-11 and can include the sensor to sense a pressure of about 3000 psi being held for about 5 minutes.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. An apparatus comprising:

a liner or casing deployable into a wellbore;

a sleeve defining a longitudinal axis and operatively fit over the liner or casing; and a plurality of packer elements disposed in an annular arrangement with the sleeve, wherein the sleeve with the plurality of packer elements is arranged such that the liner or the casing, having the sleeve disposed over the liner or casing, is capable of rotation within the sleeve when the sleeve is operationally non-rotating, and wherein the plurality of packer elements are expandable to press against a wall of the wellbore to hold the sleeve in a non-rotating position within the wellbore.

2. The apparatus of claim 1, wherein the sleeve is positionable above a drill bit operably coupled to the liner.

3. The apparatus of claim 1, wherein the sleeve includes bearings or bushings attached to an inner surface of the sleeve such that the bearings are between the sleeve and the liner or the casing when the sleeve is fitted over the liner or the casing, the bearings or bushings structured to allow the liner or the casing to rotate when the sleeve is non-rotating.

4. The apparatus of claim 1, wherein the apparatus includes anchor devices to anchor the sleeve to the liner or the casing and bushings that allow the liner or the casing to rotate when the sleeve is non-rotating.

5. The apparatus of claim 1, wherein the apparatus includes thrust bearings to allow the liner or the casing to rotate when a thrust load is applied to the sleeve.

6. The apparatus of claim 1, wherein the apparatus includes a stage collar having a port to dispense cement, the stage collar positionable above or below the sleeve.

7. The apparatus of claim 1, wherein the apparatus includes a communication device and an activation device arranged to operatively expand the packer element to press against a wall of the wellbore to hold the sleeve in a non-rotating position.

8. The apparatus of claim 7, wherein the activation device includes a valve, a piston, or a hydrostatic piston.

9. The apparatus of claim 1, wherein the apparatus includes a module to open a port for fluid flow, the module having an actuator responsive to a sensor.

10. The apparatus of claim 1, wherein the is attached to the sleeve such that the plurality of packer elements is disposed substantially completely around the sleeve.

11. The apparatus of claim 1, wherein the plurality of packer elements are arranged in an axial orientation with respect to the longitudinal axis of the sleeve.

12. The apparatus of claim 1, wherein the plurality of packer elements are compression-type packers operable to deform outwardly upon being squeezed to seal against the wall of the wellbore and isolate a high pressure zone from a low pressure zone in the wellbore.

13. A method comprising: drilling a liner to a depth at a well site; activating a packer to seal against a wall of a wellbore and seal off a region below the packer, the packer being an element of a sleeve fitted around the liner, the sleeve structured to allow activating the packer to hold the sleeve in a non-rotating position and to allow the liner to rotate with the sleeve in the non-rotating position; pumping cement through a port into an annulus around the liner in the wellbore; and rotating the liner with the sleeve in the non-rotating position during pumping the cement.

14. The method of claim 13, wherein pumping the cement includes pumping the fluid cement above the packer.

15. The method of claim 13, wherein pumping the cement includes pumping the cement below the packer.

16. The method of claim 13, wherein pumping the fluid includes pumping fluid above the packer and pumping the cement below the packer.

17. The method of claim 13, wherein pumping the cement includes pumping the cement to pass through an additional packer in the annulus from above the additional packer to below the additional packer or pumping the cement to pass through the additional packer in the annulus from below the additional packer to above the additional packer.

18. The method of claim 13, wherein pumping the cement includes pumping cement between a plurality of additional packers; and pumping cement above one of the plurality of additional packers and pumping fluid below another one of the plurality of additional packers.

19. The method of claim 13, wherein activating the packer to seal against the wall of the wellbore and sealing off the region below the packer includes activating a plurality of packers to seal against the wall of the wellbore and to seal off the region below the packer.

20. The method of claim 13, wherein the method includes controlling the opening and closing of the port through which the fluid flows using a sensor arranged to sense presence of a device or sense a parameter associated with an environment in which the sensor is disposed.

21. The method of claim 20, wherein the sensor senses a plug as the plug passes within vicinity of the sensor.

22. The method of claim 20, wherein the sensor senses pressure in a pressure range for a specified time.

23. The method of claim 22, wherein the sensor senses a pressure of about 3000 psi being held for about 5 minutes.

* * * * *